United States Patent [19]

Hirai et al.

[11] Patent Number: 4,923,132

[45] Date of Patent: May 8, 1990

[54] DOFFING TRUCK FOR A YARN FALSE TWISTING MACHINE

[75] Inventors: Kazuyasu Hirai, Nagaokakyo; Yasuhiro Inoue, Settsu; Kazuyoshi Suzuki, Nara, all of Japan

[73] Assignee: Murata Kikai Kabushiki Kaisha, Kyoto, Japan

[21] Appl. No.: 134,865

[22] Filed: Dec. 18, 1987

[30] Foreign Application Priority Data

Dec. 26, 1986 [JP] Japan ..... 61-308802
Jul. 21, 1987 [JP] Japan ..... 62-111627

[51] Int. Cl.[5] ..... B65H 54/26; B65H 67/04

[52] U.S. Cl. ..... 242/35.5 A

[58] Field of Search ..... 242/35.5 A, 35.5 R; 57/270, 268, 266

[56] References Cited

U.S. PATENT DOCUMENTS

| | | | |
|---|---|---|---|
| 3,791,126 | 2/1974 | Kose et al. | 242/35.5 A |
| 3,811,631 | 5/1974 | Mayer et al. | 242/35.5 A |
| 3,987,974 | 10/1976 | Mayer | 242/35.5 A |
| 4,007,882 | 2/1977 | Isoard | 242/35.5 A |
| 4,125,990 | 11/1978 | Stahlecker et al. | 242/35.5 A |
| 4,139,162 | 2/1979 | Stahlecker | 242/35.5 A |
| 4,178,748 | 12/1979 | Stahlecker et al. | 242/35.5 A |
| 4,427,158 | 1/1984 | Conrad | 242/35.5 A |
| 4,598,881 | 7/1986 | Lattion | 242/35.5 A |
| 4,615,493 | 10/1986 | Teranishi et al. | 242/35.5 A |

FOREIGN PATENT DOCUMENTS 62-90341 4/1987 Japan .

*Primary Examiner*—Stanley N. Gilreath
*Attorney, Agent, or Firm*—Spensley Horn Jubas & Lubitz

[57] ABSTRACT

A doffing truck for a yarn false twisting machine which travels between a plurality of juxtaposed yarn winding units and a peg stand located in an opposing relationship to the yarn winding units and exchange empty bobbins mounted on pegs of the peg stand for fully wound packages from the yarn winding units, wherein it includes a slide frame mounted for reciprocal movement between the yarn winding units and the peg stand, a support arm for receiving a fully wound package from the yarn winding unit and mounting it onto the peg and a bobbin chucking device mounted on the slide frame for holding a bobbin and mounting the bobbin onto the yarn winding unit.

20 Claims, 22 Drawing Sheets

DOFFING TRUCK FOR A YARN FALSE TWISTING MACHINE

FIELD OF THE INVENTION

This invention relates to a yarn false twisting machine for winding a melt spinning filament yarn after false twisting operation, and more particularly to a doffing truck for a yarn false twisting machine for exchanging a package fully wound up on a yarn winding unit for an empty bobbin mounted on a peg stand.

RELATED ART STATEMENT

The applicant of the present patent application has already proposed Japanese Patent Application No. 60-227476 (Provisional Publication No. 62-90341).

The invention of the preceding patent application relates to a method and device for automatically exchanging a fully wound package wound up on a yarn winding unit for an empty bobbin mounted on a peg stand by means of a doffing truck and for automatically effecting guiding and cutting of yarn upon winding of the yarn.

By the way, the doffing truck of the invention of the preceding patent application is constituted such that a support arm on the doffing truck receives a package wound up on a yarn winding unit and is turned by 90 degrees in a horizontal direction, and in this condition, the fully wound package is moved toward a peg stand in order to mount the bobbin of the fully wound package onto a peg of the peg stand. A bobbin mounted on the peg stand is pulled off the peg stand by a bobbin support arm mounted on the doffing truck and is then received by a bobbin supplying arm which then mounts the bobbin onto the winding unit. However, the doffing truck is disadvantageous in that, since delivery of a bobbin is carried out in the doffing truck, a doffing operation requires much time accordingly and the structure of the doffing truck readily increases in size.

OBJECT AND SUMMARY OF THE INVENTION

It is an object of the present invention to provide a yarn false twisting machine including a doffing truck which can pull a bobbin off a peg stand and mount it directly onto a yarn winding unit.

In order to attain the object, according to the present invention, there is provided a doffing truck for a yarn false twisting machine which travels between a plurality of juxtaposed yarn winding units and a peg stand located in an opposing relationship to the yarn winding units and exchanges empty bobbins mounted on pegs of the peg stand for fully wound packages from the yarn winding units, which is constituted such that it comprises a slide frame mounted for reciprocal movement between the yarn winding units and the peg stand, a support arm mounted for up and down movement relative to the slide frame and also for horizontal turning motion for receiving a fully wound package from one of the yarn winding devices and mounting the received fully wound package onto one of the pegs of the peg stand, and a bobbin chucking device mounted for up and down movement and also for horizontal turning motion and up and down pivotal motion on the slide frame for holding a bobbin thereon and directly mounting the bobbin onto one of the yarn winding units. Thus, a bobbin on the peg stand is gripped by the bobbin chucking device and then the slide frame is moved toward the yarn winding devices to pull the bobbin off a peg of the peg stand. Then, the bobbin chucking device is turned in a horizontal direction and also in up and down directions to mount the bobbin onto one of the yarn winding devices. Meanwhile, the support arm receives a fully wound package from one of the yarn winding devices and moves it toward the peg stand where after it is turned in a horizontal direction to mount the fully wound package onto the peg stand while at the same time the bobbin chucking device holds a bobbin thereon. Accordingly, holding of a bobbin on the peg stand and mounting of the bobbin onto one of the yarn winding devices can be carried out by means of the same bobbin chucking device, which allows a doffing operation to be performed efficiently.

DETAILED DESCRIPTION OF THE INVENTION

Now, a preferred embodiment of a yarn false twisting machine of the present invention will be described with reference to the accompanying drawings.

At first, an entire construction will be described with reference to FIGS. 9 and 10.

Figure 9:
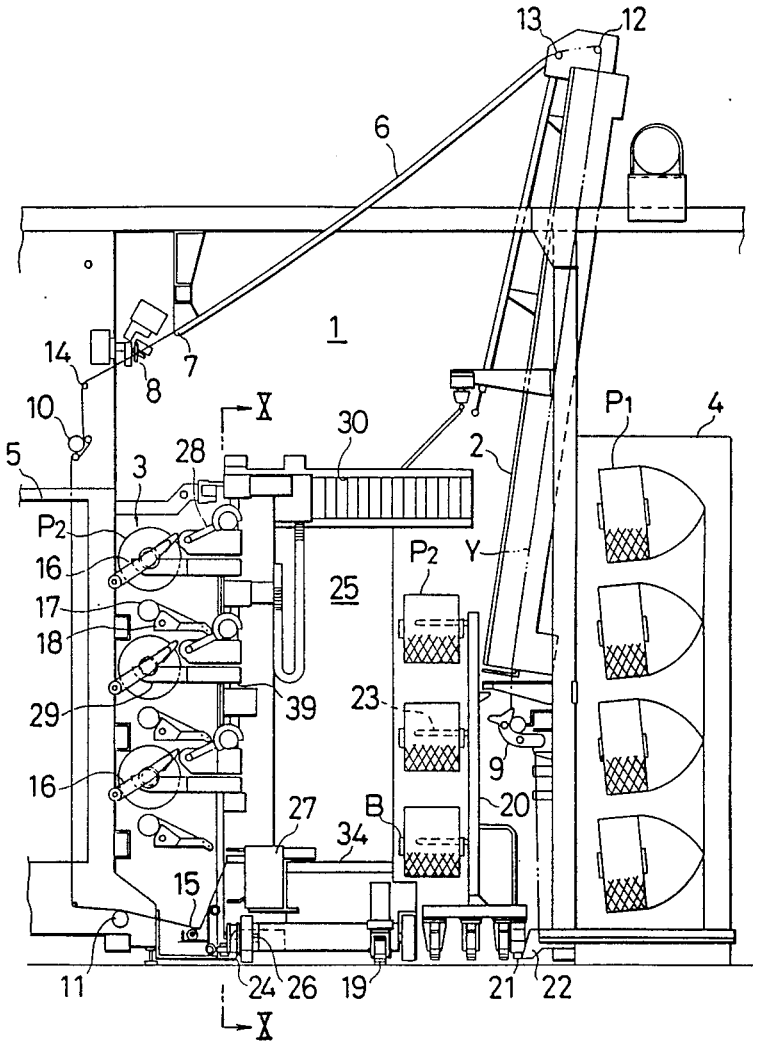
FIG. 9 is a schematic view of an entire yarn false twisting machine.
Figure 10:
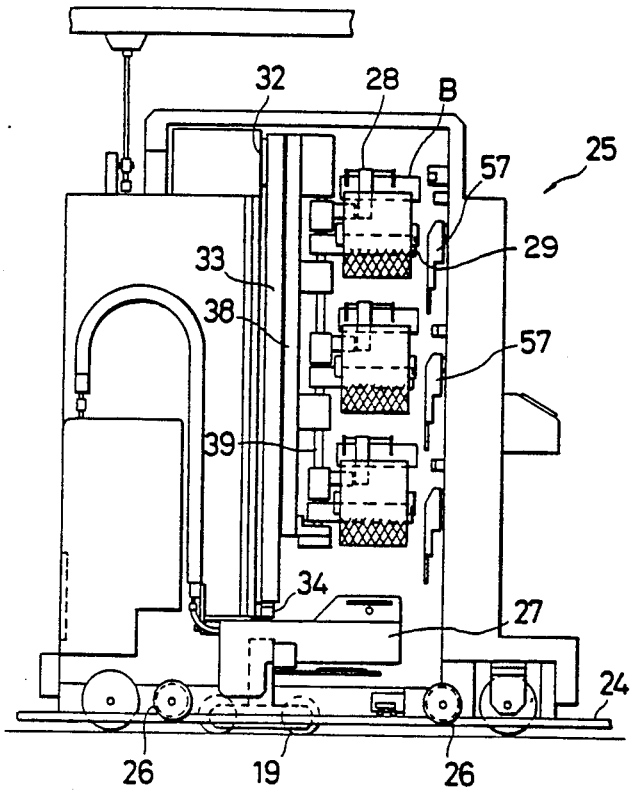
FIG. 10 is a view as viewed in a direction of an arrow mark along line X—X of FIG. 9, FIGS. 11*a*–19*c* are schematic views illustrating operations of the bobbin chucking device and the support arm according to the present invention.

FIG. 9 shows a front elevational view of an entire yarn false twisting machine, and FIG. 10 shows a view as viewed in a direction of an arrow mark along line X—X of FIG. 9.

An elongated first heater 2 is installed uprightly on one side of an operation spacing 1, and a plurality of yarn winding units 3 are located on the other side of the operating spacing 1. A creel 4 on which a large number of supply yarn packages Pl are supported is located behind the first heater 2, and a second heater 5 is located behind the yarn winding units 3. A yarn cooling plate 6, a yarn guide device 7 and a yarn false twisting device 8 are located in this order above the operation spacing 1, and feed rollers 9, 10 and 11 are located below the first heater 2 and above and below the second heater 5, respectively.

A yarn Y drawn from a supply yarn package P1 passes at first the first feed roller 9 and then through the first heater 2 from below to above and is then bent successively by guide pins 12 and 13 whereafter it travels obliquely downwardly along the yarn cooling plate 6 until it passes the yarn guide device 7 and is finally introduced into the yarn false twisting device 8.

The yarn Y having passed the yarn false twisting device 8 is then bent downwardly by another guide pin 14 and then passes the second feed roller 10 whereafter it travels downwardly within the second heater 5. After then, the yarn Y passes the third feed roller 11 and a further yarn guide 15 and is thereafter wound onto a wound package P2 on a yarn winding device 3.

The yarn false twisting machine includes a total of 12 yarn winding devices 3 arranged in 3 horizontal rows and 4 vertical columns. Each of the yarn winding devices 3 includes a cradle arm 16 for supporting a winding package P2 thereon, a friction roller 17 for driving the winding package P2 to rotate, a yarn guide 18 for guiding yarn Y, and so on.

A peg stand 20 in the form of a flat plate is located in front of the first heater 2 in the operation spacing 1. The stand 20 has rollers 21 mounted on a lower face thereof and received on a rail 22 mounted at a lower portion of the creel 4 so that the peg stand 20 can travel in a direction perpendicular to the plane of FIG. 9. The stand 20 is normally held stationarily at a position opposing to the yarn winding devices 3 by a stopper not shown. A total of 12 pegs 23 are implanted in 3 horizontal rows and 4 vertical rows in an equidistantly spaced relationship in vertical and horizontal directions on a face of the stand 20 opposing to the yarn winding devices 3 and extend in horizontal directions. An empty bobbin B may be fitted on each of the pegs 23. A rail 24 extends between frame members adjacent the yarn winding devices 3, and a doffing truck 25 travels in a direction perpendicular to the plane of FIG. 9 on the rail 24 by means of rollers 26 and a driving wheel 19 which moves along the floor.

A yarn threading device 27 for threading yarn on any of the yarn winding devices 3 and cutting the yarn is mounted for up and down movement on the doffing truck 25. A bobbin chucking device 28 for receiving a bobbin B from the peg stand 20 and mounting the bobbin B onto a yarn winding device 3 and a support arm 29 for receiving a package P2 wound up on a yarn winding device 3 and mounting the package P2 onto the peg stand 20 are provided for each of the yarn winding devices 3 on the doffing truck 25. Now, the bobbin chucking device 28 and the support arm 29 will be described more in detail with reference to FIGS. 1 to 10.

Figure 1:
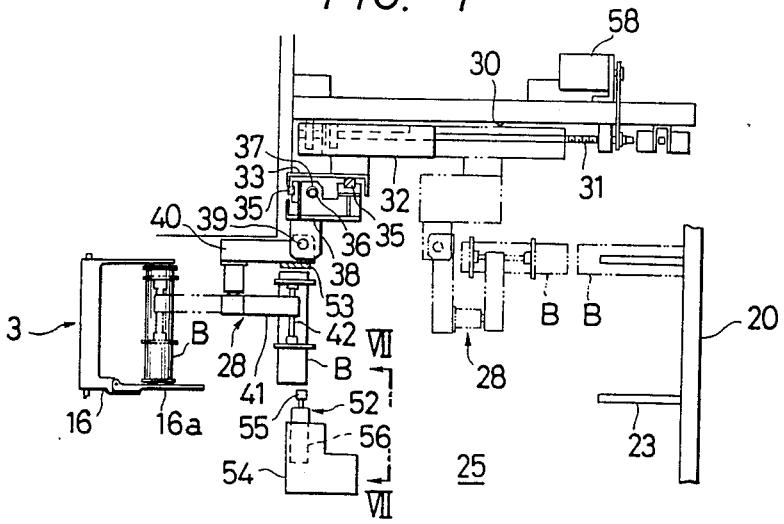
FIG. 1 is a plan view showing details of a bobbin chucking device.
Figure 2:
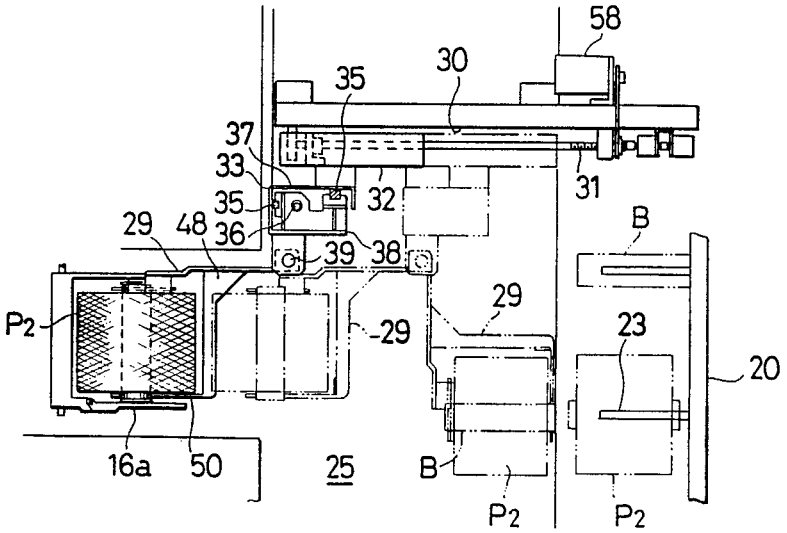
FIG. 2 is a plan view of a support arm.

As shown in FIGS. 1 and 2, a yarn winding device 3, a guide rail 30 and a threaded rod 31 are located at upper locations of the doffing truck 25. The guide rail 30 extends toward the peg stand 20 and guides therealong a slide frame 32 which is held in threaded engagement with the threaded rod 31 so that as the threaded rod 31 is rotated, the slide frame 32 may be reciprocally moved along the yarn winding device 3 and the peg stand 20. As shown in FIGS. 9 and 10, the slide frame 32 has a vertical guide frame 33 at a lower portion thereof. The guide frame 33 is supported at a lower end thereof for reciprocal sliding movement on a guide rail 34 located at a lower portion of the doffing truck 25.

A pair of vertical guide rails 35 and a vertical threaded rod 36 are mounted on the guide frame 33 as shown in FIGS. 1 and 2.

Meanwhile, a liftable base 38 is provided which is held in engagement and for up and down movement together with the guide rails 35 and has a threaded portion 37 which is held in threaded engagement with the threaded rod 36.

A vertical guide rod 39 is mounted on the liftable base 38, and a bobbin chucking device 28 for holding a bobbin B thereon and a support arm 29 for supporting a package P2 thereon are mounted on the guide rod 39.

Figure 3:
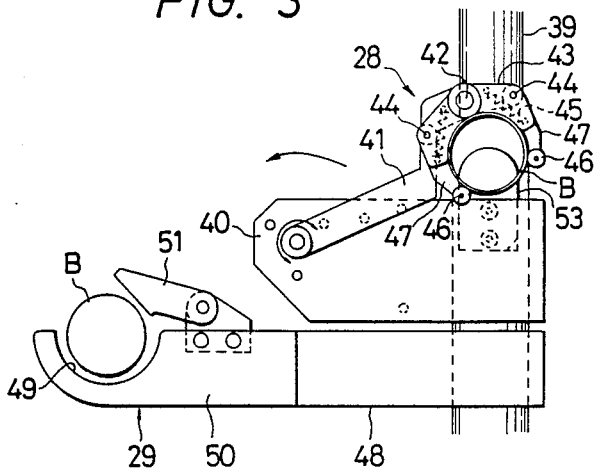
FIG. 3 is a detailed front elevational view of the bobbin chucking device and the support arm.

The bobbin chucking device 28 includes, as shown in FIGS. 1 and 3, a turning base portion 40 fitted around the guide rod 39 and turned by 90 degrees in a horizontal direction by a turning driving device, an up and down pivotal arm 41 supported for up and down pivotal motion on the turning base portion 40, a shaft 42 securely mounted at an end of the arm 41, a pair of gripping base plates 43 mounted at opposite ends of the shaft 42, and two pairs of gripping pawls 47 connected at opposite ends of the gripping base plates 43 by means of pins 44 and normally urged in a closing direction by means of springs 45. Each of the gripping pawls 43 has a roller 46 provided at an end thereof.

Figure 4:
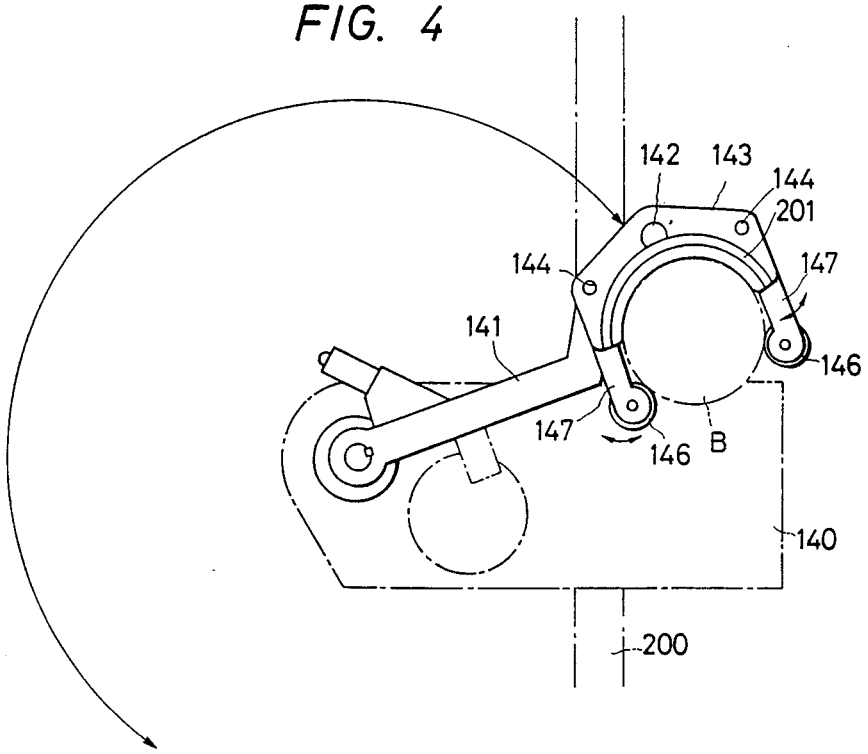
FIG. 4 is a front elevational view of another embodiment of the bobbin chucking device.
Figure 5:
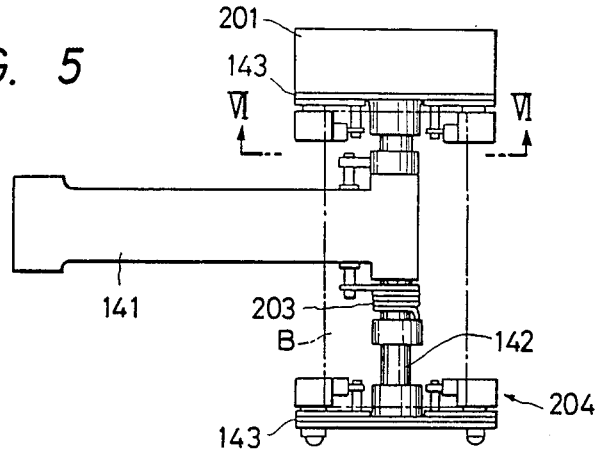
FIG. 5 is a bottom view of the bobbin chucking device of FIG. 4.
Figure 6:
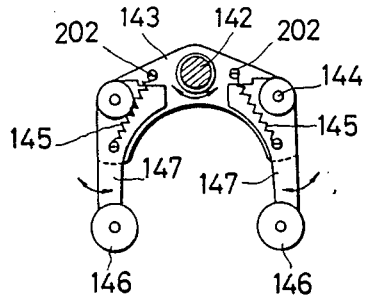
FIG. 6 is sectional view along line VI—VI of FIG. 5.

Another embodiment of the bobbin chucking device 28 is illustrated in FIGS. 4 to 6. A turning base portion 140, on which a pivotal arm 141 is supported for up and down pivotal motion, is equidistantly secured to a connecting shaft 200 which is vertically mounted on the doffing truck. The arm 141 provides a shaft 142 rotatably at the top end portion thereof and a pair of bobbin chuckers 204 is supported on the shaft 142 at both sides thereof, respectively. The bobbin chucker 204 comprises a ]-shaped base plate 143, a pair of gripping pawls 147, 147 connected at opposite ends of the base plate 143, springs 145, 145 urging the gripping pawls 147, 147 in a closing direction and rollers 146, 146 provided to be rotatably at an end of each of the gripping pawls 147, 147. The bobbin chucker 204 is rockable around the shaft 142 to be a center as the base plate 143 is fixed to the shaft 142. The bobbin chucker 204 is always urged in a clockwise direction in FIG. 4 by controlling the rotation of the shaft 142 by means of a spring 203 provided on the shaft 142. An arcuate guide member 201 may be secured on the outer side portion of one of the base plate 143 of the bobbin chucker 204. The guide member 201 is formed to be the same shape as the arcuate outer peripheral portion of a bobbin holder 60 which is rotatably supported on the cradle arm 16. In this manner, the guide member 201 may abut the outer peripheral portion of the bobbin holder 60 so as to precisely position a bobbin on the bobbin holder 60.

The support arm 29 includes, as shown in FIGS. 2 and 3, a frame portion 48 fitted for horizontal turning motion by 90 degrees around the guide rod 39, and a pair of arm portions 50 provided in an integral relationship on the frame portion 48 and each having at an end thereof a receiving portion 49 for receiving an end of a bobbin thereon. One of the arm portions 50 has a holding pawl 51 provided for pivotal motion thereon for holding a bobbin B of a package P2 supported on the receiving portions 49.

A bobbin positioning device 52 is located on the doffing truck 25 for adjusting the gripped position of a bobbin when the bobbin B is mounted onto the winding device 3 by the bobbin chucking device 28. The positioning device 52 includes a positioning plate 53 mounted on the turning base portion 40 of the bobbin chucking device 28, and a positioning cylinder 56 mounted on a frame 54 of the doffing truck 25 for pressing an end portion of a bobbin B against the positioning plate 53 by means of a presser 55.

In the present invention, the bobbin chucking device 28 and the package support arm 29 are constituted to be driven independently each other so that a bobbin which has been removed from the peg stand by the bobbin chucking device 28 is directly supplied and mounted onto the cradle arm of a yarn winding unit.

Figure 8:
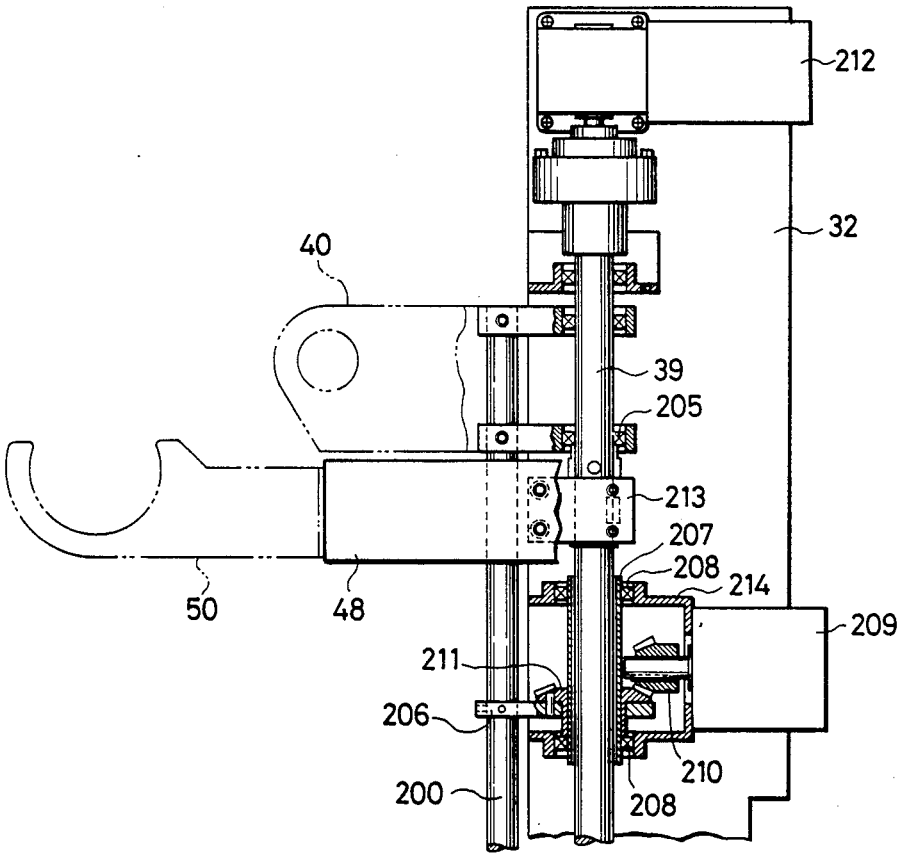
FIG. 8 is a front view partly cut-away to illustrate a driving mechanism of the bobbin chucking device and the support arm.

The driving mechanism of the bobbin chucking device 28 and the support arm 29 is illustrated referring to FIG. 8. The turning base portion 40 of the chucking device 28 is turnably supported by the guide rod 39 through bearing 205 and is secured to the connecting rod 200. A gear box 214 which includes bevel gears 210 and 211 is supported by the guide rod 39 through a pipe 207 and bearing 208. The connecting rod 200 is driven by a rotary cylinder 209 actuated by a compressed air through the gear box 214 and a connecting plate 206 to turn the turning base portion 40 in horizontal direction. While, the guide rod 39 is rotated by a motor 212 to turn the frame portion 48 of the support arm 29 in a horizontal direction, which is connected to and supported by the guide rod 39 through a connecting plate 213.

A cradle operating arm 57 for operating the cradle arm 16 of the yarn winding device 3 is located on the frame 54 of the doffing truck 25 (FIG. 10). The cradle operating arm 57 is constituted as will be hereinafter described with reference to FIGS. 20 to 34 such that it pivots a movable side arm 16*a* of the cradle arm 16 upwardly to remove a fully wound package P2 from the friction roller 17 and opens the movable side arm 16*a* to remove the fully wound package P2 from the cradle arm 16 whereafter it pivots the cradle arm 16 downwardly to press the friction rollers 17 against a bobbin when the bobbin B is to be mounted onto the cradle arm 16.

Now, a doffing operation for exchanging a bobbin B on the peg stand 20 and a fully wound package P2 when the package P2 is wound up on the yarn winding device 3 will be described.

At first, basic operations of the bobbin chucking device 28 and the support arm 29 will be described with reference to FIGS. 1 to 3.

As the threaded rod 31 is rotated forwardly and reversely by a motor 58, the slide frame 32 is reciprocally moved between the yarn winding device 3 and the peg stand 20 to reciprocally move the bobbin chucking device 28 and the support arm 29.

On the other hand, as the threaded rod 36 of the guide frame 33 of the slide frame 32 is rotated by a motor (not shown), the liftable base 38 having the threaded portion 37 thereof held in threaded engagement with the threaded rod 36 is moved up and down under the guidance of the rails 35 of the guide frame 33 to move the bobbin chucking device 28 and the support arm 29 up and down.

The bobbin chucking device 28 can be turned at the turning base portion 40 thereof in horizontal opposite directions around the guide rod 39 of the guide frame 33 to move a bobbin B in a direction to mount the bobbin B onto the cradle arm 16 and in an opposite direction to mount the bobbin B onto a peg 23 of the peg stand 20 as shown in FIG. 1. Meanwhile, as the up and down pivotal arm 41 is pivoted up and down relative to the turning base portion 40 of the bobbin chucking device 28, the bobbin can be mounted onto the cradle arm 16.

The support arm 29 is constituted such that it receives a fully wound package P2 from the cradle arm 16 and turns it by 90 degrees to mount the bobbin B of the package P2 onto a peg 23 of the peg stand 20 as shown in FIG. 2.

Now, operations of the bobbin chucking device 28, support arm 29 and so on will be described with reference to FIGS. 11 to 19.

FIGS. 11 to 19 show different steps when a package P2 wound up on a yarn winding device 3 is received by the support arm 29 and a bobbin B is mounted onto the cradle arm 16 by the bobbin chucking device 28 whereafter the fully wound package P2 is mounted onto the peg stand 20 by the support arm 29 and the empty bobbin B on the peg stand 20 is held by the bobbin chucking device 28, and wherein FIGS. 11*a* to 19*a* show plan views of operations of the bobbin chucking device 28 described above; FIGS. 11*b* to 19*b* are plan views of operations of the support arm 29; and FIGS. 11*c* to 19*c* show front elevational views of the bobbin chucking device 28 and the support arm 29.

Figure 11A:
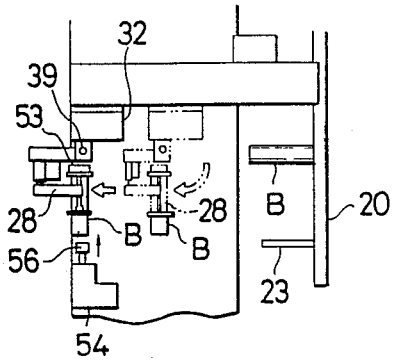
Figure 11B:
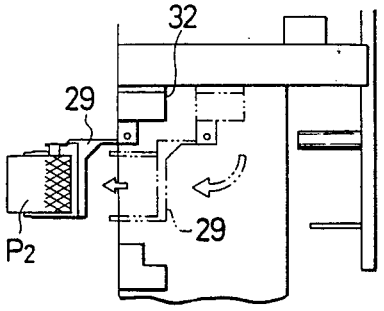
Figure 11C:
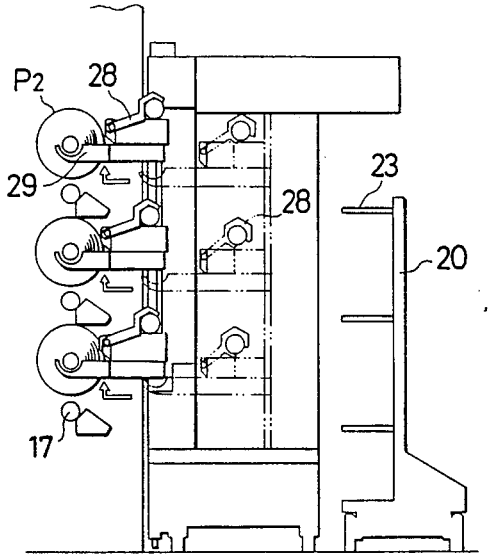

Referring to FIGS. 11*a* to 11*c*, a package P2 wound up on a yarn winding device 3 is shown removed from a cradle arm 16 by a cradle operating arm 57 which will be hereinafter described and delivered on a support arm 29. In particular, the support arm 29 is advanced from a two dot chain line position shown toward the yarn winding device 3 while it is lifted a little as shown in FIG. 11*c* until the receiving portion 49 thereof comes to a delivery position. Thereupon, a bobbin chucking device 28 is moved at the same time with the support arm 29 to hold a bobbin in a direction in which the bobbin B can be mounted onto the yarn winding device 3 and at a position above the turning base portion 40 as shown in FIG. 11*c*.

Figure 7:
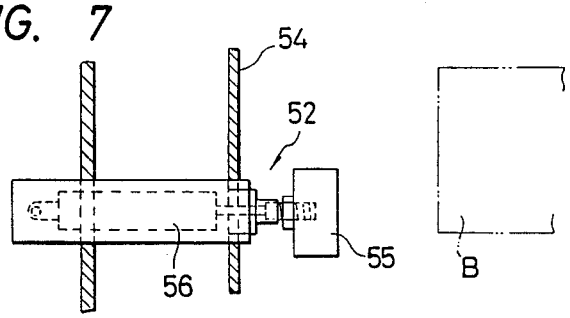
FIG. 7 is a view as viewed in direction of an arrow mark along line VII—VII of FIG. 1.

The bobbin B held by the bobbin chucking device 28 is pressed, when the fully wound package P2 is to be delivered, against the positioning plate 53 by the positioning cylinder 56 of the bobbin positioning device 52 described hereinabove with reference to FIG. 7 in order to effect positioning of the bobbin.

Figure 12A:
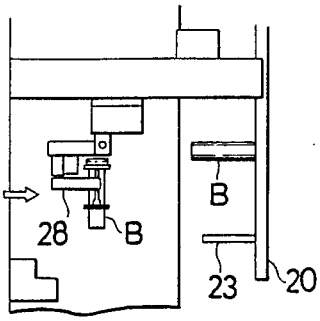
Figure 12B:
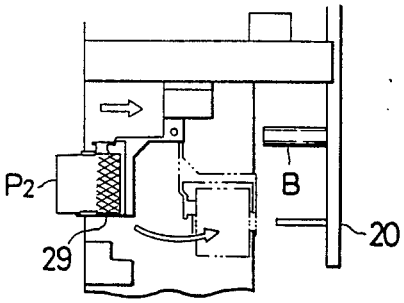

After delivery of the fully wound package P2 and positioning of the bobbin B, the bobbin chucking device 28 and the support arm 29 are retracted toward the peg stand 20 as shown in FIG. 12, and then at the retracted position, the support arm 29 is turned in a horizontal direction as shown in two dot chain lines in FIG. 12*b* so as to direct the bobbin B of the package P2 toward a peg 23 of the peg stand 20.

Figure 12C:
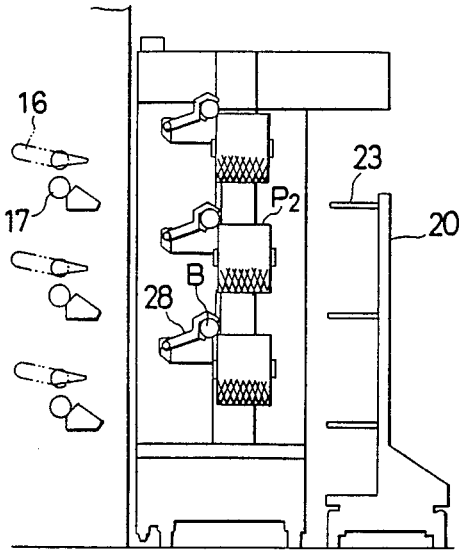
Figure 13A:
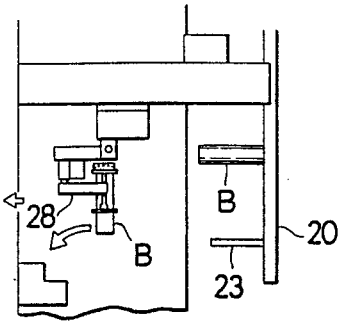
Figure 13B:
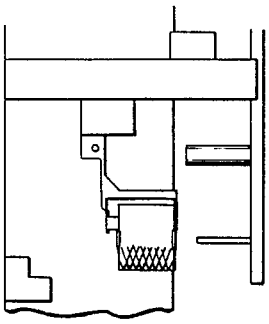
Figure 13C:
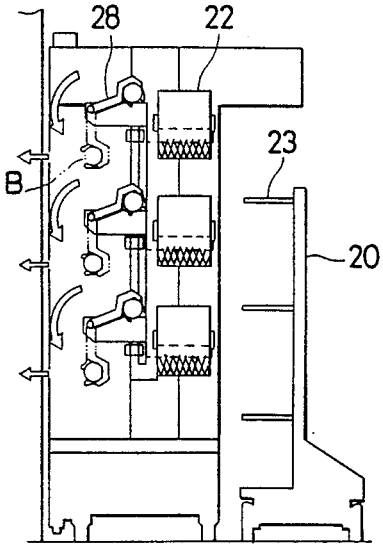

By turning motion of the support arm 29, the bobbin chucking device 28 is allowed to pivot downwardly as shown in FIGS. 12*a* and 12*c* to pivot the arm 41 of the bobbin chucking device 28 downwardly to bring the bobbin B into a lowered position as shown in FIGS. 13*a*, 13*c*.

Figure 14A:
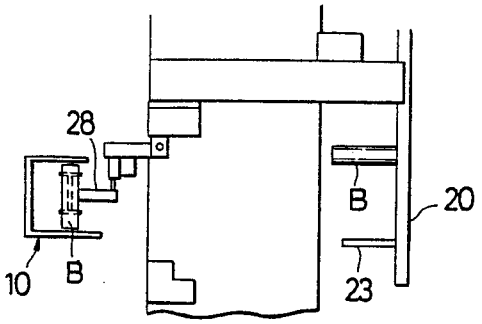
Figure 14B:
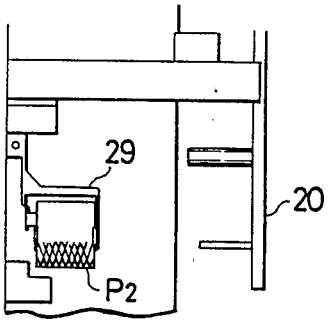
Figure 14C:
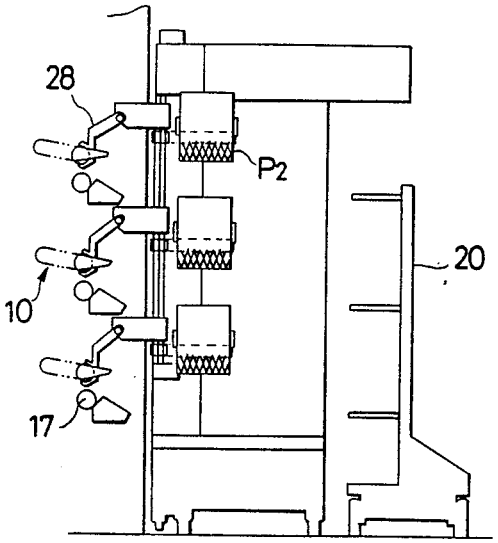

In this condition, the bobbin chucking device 28 and the support arm 29 are advanced toward the yarn winding device 3, and then the arm 41 of the bobbin chucking device 28 is pivoted upwardly as shown in FIGS. 14*a*, 14*b* so that the bobbin B is mounted between two arms of the cradle arm 16.

Figure 15A:
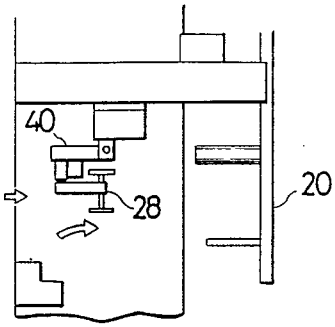
Figure 15B:
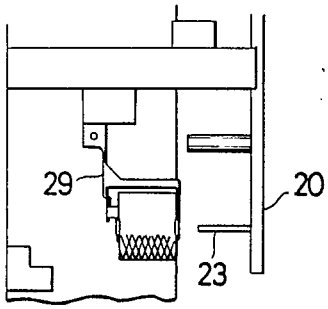
Figure 15C:
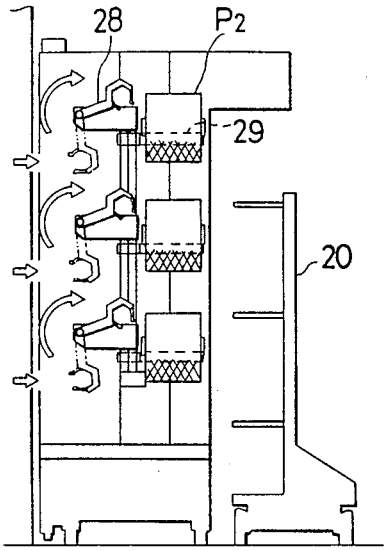

After the bobbin B has been mounted onto the cradle arm 16, the bobbin chucking device 28 is pivoted downwardly again and then the bobbin chucking device 28 and the support arms 29 are retracted toward the peg stand 20 whereafter the bobbin chucking device 28 is pivoted to a position above the turning base portion 40 as shown in FIGS. 15*a*, 15*c*.

Figure 16A:
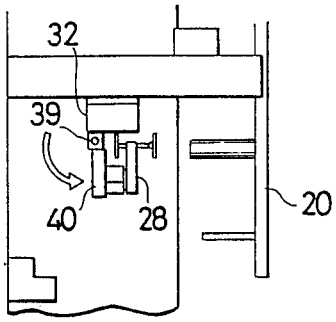
Figure 16B:
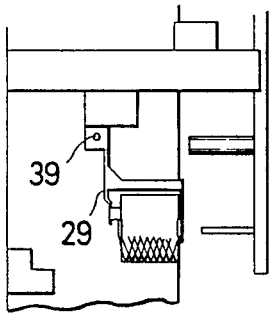
Figure 16C:
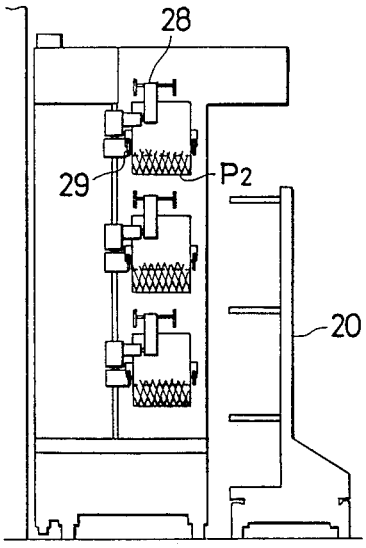

If the turning base portion 40 of the bobbin chucking device 28 is turned as shown in FIG. 16*a* from the condition of FIG. 15, then it will come to a position above the package P2 on the support arm 29 which is directed toward a peg 23 as shown in FIG. 16*c*. In this instance, the bobbin chucking device 28 is positioned in a direction of a bobbin Ba mounted on a peg 23 positioned forwardly in the advancing direction of the doffing truck 25 while the direction of the bobbin B of the package P2 on the support arm 29 is positioned in a direction of an empty peg 23*a* from which a bobbin has been pulled off upon a preceding doffing operation.

Figure 17A:
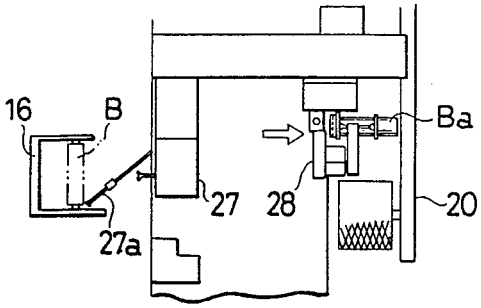
Figure 17B:
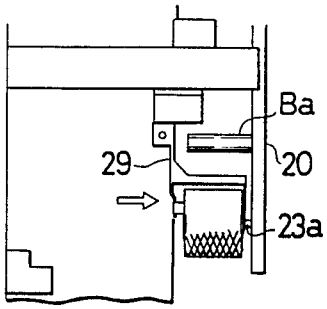

From the condition of FIG. 16, the bobbin chucking device 12 and the support arm 29 are lowered until the bobbin B of the package P2 on the support arm 29 comes to a vertical position at which the bobbin B can be fitted onto the empty peg 23*a*. In this position, if the bobbin chucking device 28 and the support arm 29 are retracted toward the peg stand 20 as shown in FIG. 17, the package P2 on the support arm 29 is mounted onto the corresponding peg 23*a* of the peg stand 20.

Figure 18A:
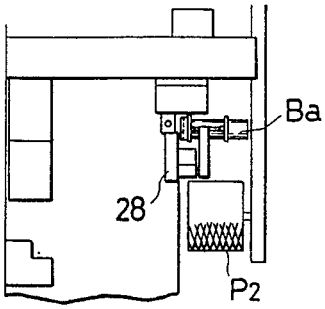
Figure 18B:
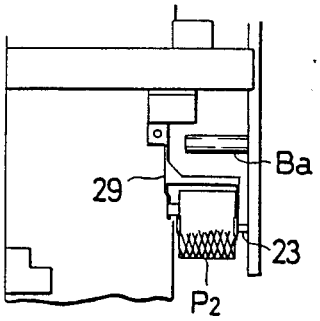
Figure 18C:
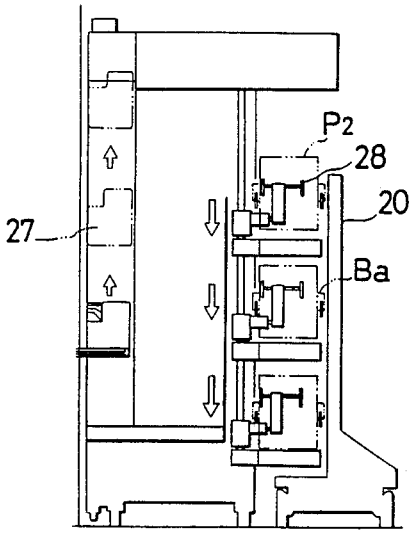

Upon such mounting of the fully wound package P2, the bobbin chucking device 28 is positioned above the empty bobbin Ba positioned forwardly of the package P2. Thus, as the support arm 29 and the bobbin chucking device 29 are lowered further as shown in FIG. 18, the empty bobbin Ba is held by the bobbin chucking device 28 while the support arm 29 comes to a position below the fully wound package P2 supported newly on the peg 23*a*.

When the bobbin chucking device 28 is lowered so as to hold the empty bobbin Ba onto it, the rollers 46 at the ends of the gripping pawls 47 are contacted with the bobbin B so that the gripping pawls 47 are opened against forces of the springs 45 as shown in FIG. 3 and thus allowed to hold the bobbin B between them.

After the bobbin B has been held by the bobbin chucking device 28, the bobbin chucking device 28 and the support arm 29 are advanced toward the yarn winding device 3 as shown in FIG. 19 and then turned toward the yarn winding device 3 in order to effect exchanging of a new fully wound package P2 on another winding device for the bobbin B again.

Figure 17C:
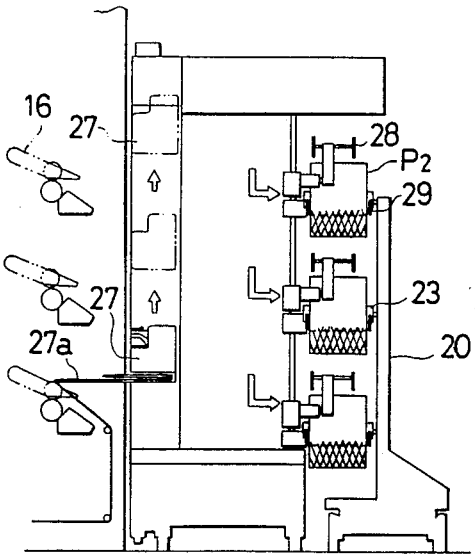
Figure 19A:
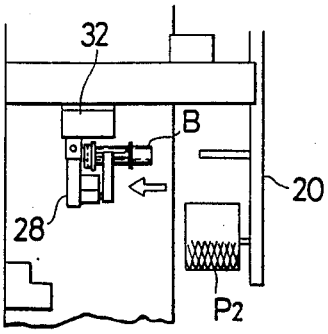
Figure 19B:
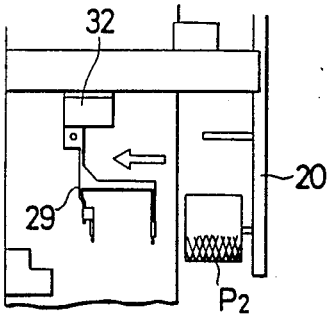
Figure 19C:
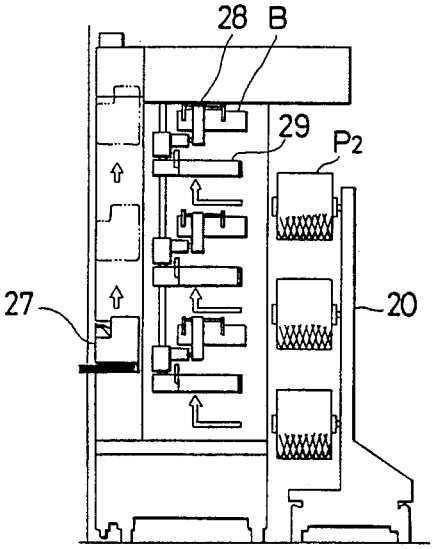

While mounting the fully wound package P2 on the peg stand 20 and holding the bobbin Ba, the yarn threading device 27 provided on the doffing truck 25 as shown in FIG. 19*c* cuts, when the package P2 on the yarn winding device 3 is wound up, supply yarn Y to the yarn winding device 3 and then keeps the supply yarn Y held thereon. Then, after a new bobbin B has been mounted onto each cradle arm 16, a yarn threading arm 27*a* of the yarn threading device 27 effects threading of yarn to the yarn winding devices 3 from the upper to lower rows as shown in FIGS. 17*a*, 17*c*.

Figure 20:
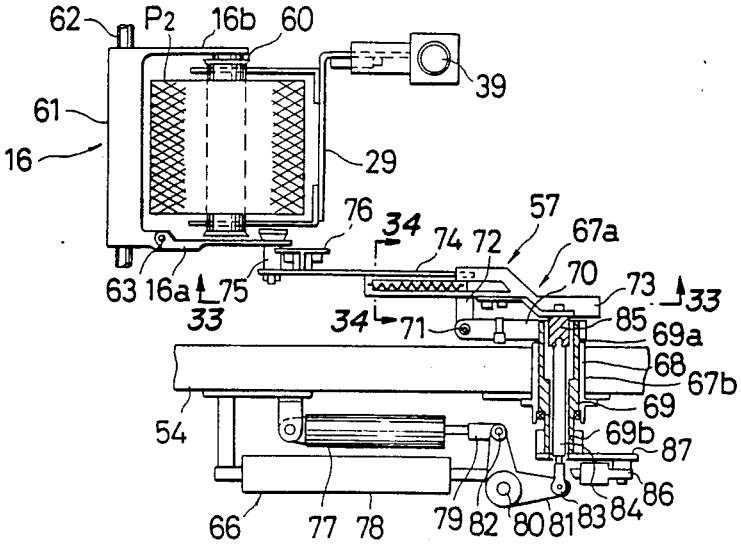
FIGS. 20 to 32 are schematic views illustrating operations of a cradle operating arm according to the present invention.

On the other hand, when a fully wound package P2 is to be removed from the cradle arm 16 and when a bobbin B is to be mounted onto the cradle arm 16 and contacted with the friction roller 17, such operations are carried out by the cradle operating arm 57 shown in FIG. 20.

Now, construction and operation of the cradle operating arm 57 will be described with reference to FIGS. 20 to 34.

Figure 21:
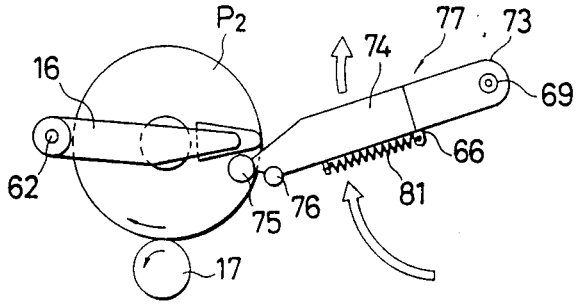

Referring to FIGS. 20 and 21, the cradle arm 16 has a pair of shafts 62 at opposite ends of a base portion 61 thereof, and the shafts 62 are supported for rotation on a support frame (not shown) of a yarn winding device 3 so that two arms 16*a*, 16*b* provided at the opposite ends of the base portion 61 can be pivoted up and down.

A bobbin holder 60 for holding a bobbin B for rotation is provided on each of the arms 16*a*, 16*b*. The arm 16*a* is connected for relative movement to the base portion 61 by means of a pin 63 while the other arm 16*b* is connected in an integral relationship to the base portion 61. The movable arm 16*a* is normally urged in a closing direction by a spring or the like (not shown).

Meanwhile, the cradle operating arm 57 for pivoting the movable arm 16*a* of the cradle arm 16 in up and down directions and for moving the movable arm 16*a* in opening and closing directions is located on the frame 54 of the doffing truck 25, and an actuating means 66 for pivoting the cradle operating arm 57 in up and down directions and for moving the cradle operating arm 57 in up and down directions is also provided.

The cradle operating arm 57 includes an operating arm portion 67*a* pivoted in the up and down directions and moved in the opening and closing directions for operating the movable arm 16*a* of the cradle arm 16, and a mounting portion 67*b* for supporting the operating arm portion 67*a* for pivotal motion and also for opening and closing movement on the frame 54.

At first, the mounting portion 67*b* includes a fixed shaft receiving tube 68 mounted on the frame 54, a rotary shaft tube 69 fitted for rotation in the fixed shaft receiving tube 68, and a turning support arm 70 mounted at an end portion 69*a* of the rotary shaft tube 69 adjacent the cradle arm 16.

The operating arm portion 67*a* includes a rockable arm 72 connected to an end of the turning support arm 70 by means of a pin 71, a movable base portion 73 mounted in an integral relationship on the rockable arm 72 and extending in a direction toward the movable arm 16*a*, and a slide arm 74 mounted for sliding movement on the movable base portion 73.

Mounted at an end of the slide arm 74 are an operating roller 75 for engaging with the movable arm 16*a*, and a presser 76 consisting of a roller or the like for pressing against the movable arm 16*a*.

Meanwhile, the actuating means 66 includes an opening and closing cylinder 77 for moving the operating arm portion 67*a* of the cradle operating arm 57 in opening and closing directions around the pin 71, and a pivoting cylinder 78 for pivoting the operating arm portion 67*a* up and down via the rotary shaft tube 69.

The opening and closing cylinder 77 has a rod end portion 79 thereof connected by means of a pin to an end 82 of an L-shaped lever 81 mounted for pivotal motion around a shaft 80 on the frame 54. Connected by means of a pin to the other end 83 of the lever 81 is an operating rod 84 loosely fitted in the rotary shaft tube 69. The other end of the operating rod 84 is connected to the movable base portion 73 of the operating arm portion 67*a* by way of a ball joint 85.

Meanwhile, a rod end portion 86 of the pivoting cylinder 78 is connected by means of a pin to a pivotal lever 87 mounted at the end portion 69*b* of the rotary shaft tube 69.

Figure 33:
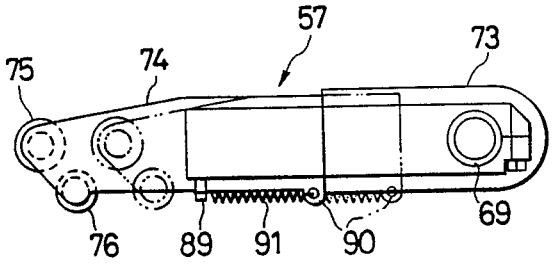
FIG. 33 is a view taken along line 33—33 of FIG. 20.
Figure 34:
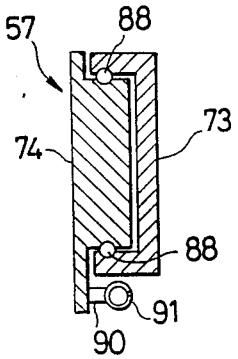
FIG. 34 is a cross sectional view taken along line 34—34 of FIG. 20.

The slide arm 74 mounted for sliding movement on the movable base portion 73 is provided for reciprocal sliding movement by means of a ball bearing 88 as shown in FIG. 34 and has a support pin 89 as shown in FIG. 33 provided at an end of the movable base 73. On the other hand, another support pin 90 is provided at the rear end of the slide arm 74, and a tension spring 91 is stretched between the pins 89, 90. Accordingly, the slide arm 74 is normally urged in an extending direction by a force of the tension spring 91.

Now, operation of the cradle operating arm 57 will be described with reference to FIGS. 20 to 34.

At first, a basic operation of the operating arm portion 67*a* of the cradle operating arm 57 will be described.

When the rod end portion 79 of the opening and closing cylinder 77 of the actuating means 66 is contracted, the lever 81 is pivoted leftwardly around the shaft 80. Consequently, the operating rod 84 is pushed in by the lever 81 so that the operating arm portion 67*a* is pivoted via the ball joint 85 around the pin 71 in a direction to move the end thereof toward the frame 54 as shown in FIG. 20.

Figure 22:
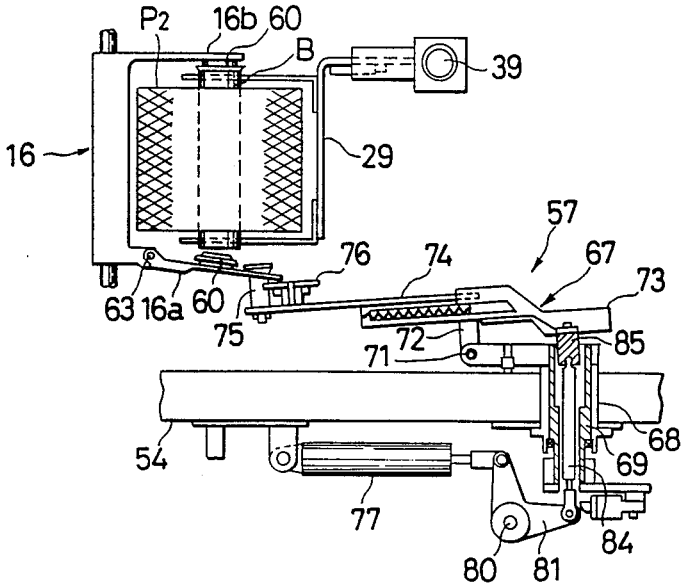

To the contrary, as the rod end portion 79 of the opening and closing cylinder 77 is extended, the lever 81 is pivoted rightwardly around the shaft 80 to pull the operating rod 84. Consequently, the operating arm portion 67*a* is pivoted via the ball joint 85 around the pin 71 in a direction to move the end thereof away from the frame 54 as shown in FIG. 22.

Then, when the pivoting cylinder 78 of the actuating means 66 is extended and contracted, the pivotal lever 87 pin-connected to the rod end portion 86 of the pivoting cylinder 78 is pivoted to rotate the rotary shaft tube 69. By such rotation of the rotary shaft rube 69, the turning support arm 70 is pivoted so that the operating arm portion 67*a* connected to the turning support arm 70 by the pin 71 is pivoted up and down. In this instance, the ball joint 85 provided at the center of pivotal motion of the operating arm portion 67*a* is rotated freely as the operating arm portion 67*a* is pivoted. Accordingly, rotation of the rotary shaft tube 69 is not transmitted to the operating rod 84.

Now, operation of the cradle operating arm 57 in a doffing operation will be described.

Figure 23:
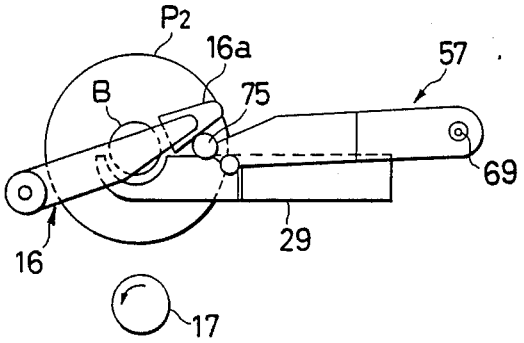

At first, when yarn has been fully wound on a bobbin B on a yarn winding device 3, the supply yarn is cut and the cradle operating arm 57 is pivoted upwardly with the operating roller 75 thereon contacted with a lower face of the movable arm 16*a* of the cradle arm 16 as shown in FIG. 17, thereby to move the fully wound package P2 away from the friction roller 17. In this condition, the support arm 29 is moved to its receiving position below the opposite ends of the bobbin B of the fully wound package P2 as shown in FIG. 23, and then the cradle operating arm 57 is pivoted toward the frame 54 as shown in FIG. 22. Then, as the movable arm 16*a* is opened by the operating roller 75, the fully wound package P2 on the bobbin holder 60 of the movable 16*a* is removed from the bobbin ends and thus delivered onto the support arm 29.

Figure 24:
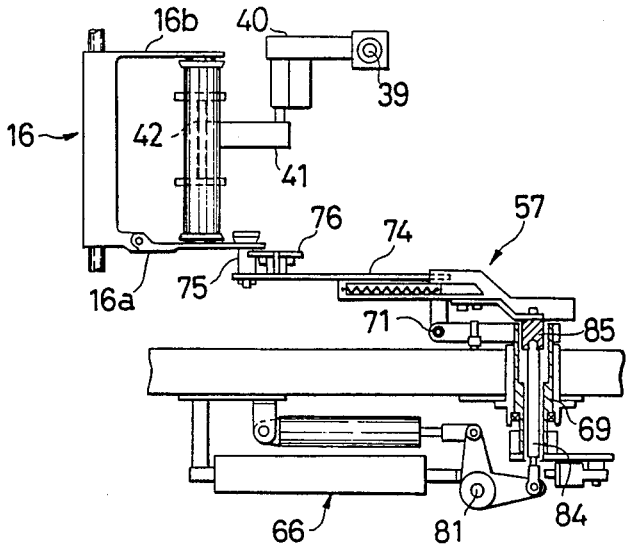
Figure 25:
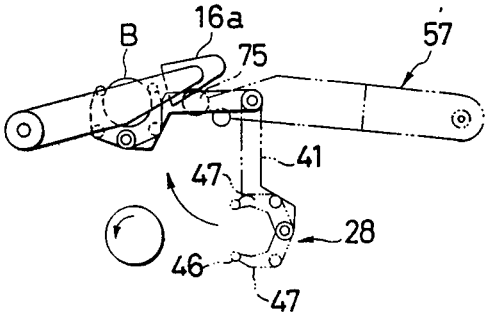
Figure 26:
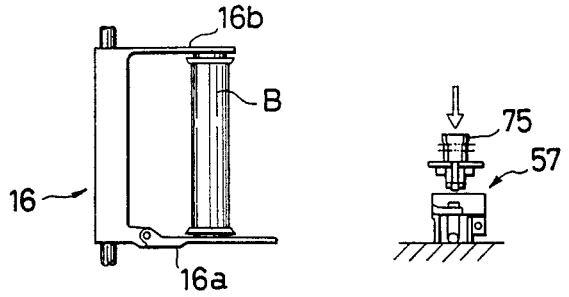
Figure 27:
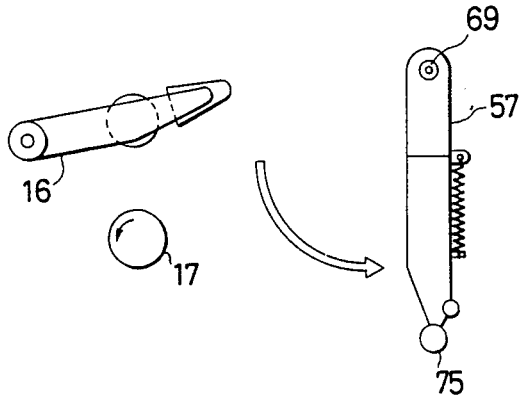
Figure 28:
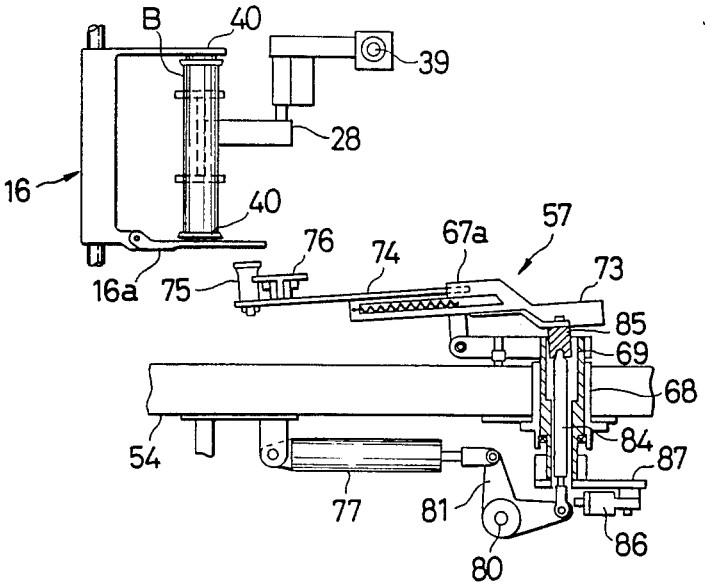

After the fully wound package P2 has been moved, an empty bobbin B is held between the two arms of the cradle arm 16 by the bobbin chucking device 28 as shown in FIGS. 24, 25, and then the cradle operating arm 57 is pivoted downwardly with the movable arm 16*a* held in the open condition as shown in FIGS. 26, 27. As a result, the operating roller 75 of the operating arm 57 is disengaged from the movable arm 16*a* so that the movable arm 16*a* is closed by a spring force to hold the bobbin B thereon.

Figure 29:
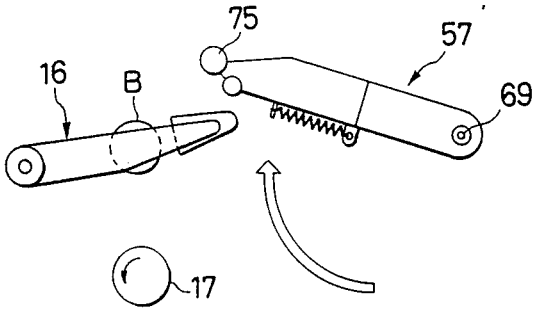

The cradle arm 16 is designed such that even if the cradle operating arm 57 is pivoted away therefrom, it may keep its pivoted position. Meanwhile, if the cradle operating arm 57 is pivoted upwardly as shown in FIG. 29 with the end thereof held pivoted to the frame 54, the operating roller 75 at the end thereof passes by the movable arm 16*a* of the cradle arm 16 and is thus positioned above the cradle arm 16.

Figure 31:
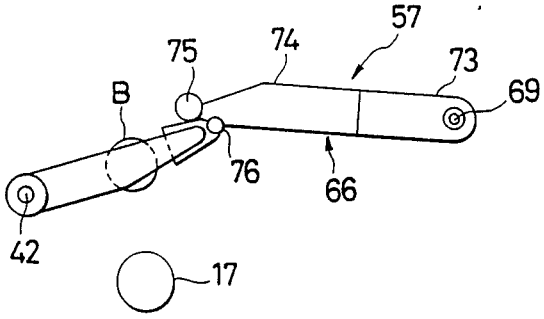

After then, the cradle arm 57 is moved to a position parallel to the frame 54 and pivoted downwardly until the operating roller 75 is contacted with an upper face of the movable arm 16*a* of the cradle arm 16 as shown in FIG. 31.

Figure 30:
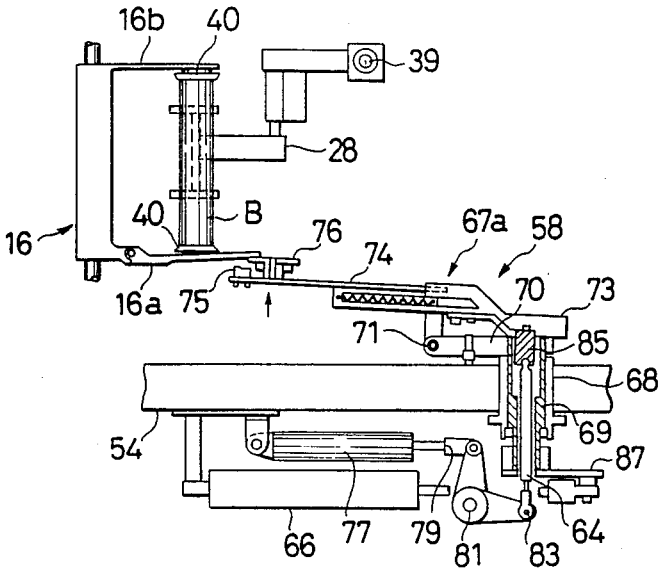

In this instance, the presser 76 of the cradle operating arm 57 is in a condition contacted with a side face of the movable arm 16*a*. In this condition, the rod end portion 79 of the opening and closing cylinder 77 of the actuating means 66 is moved in its contracting direction as shown in FIG. 30. Consequently, the operating rod 84 is pulled in via the lever 81 so that the operating arm portion 67*a* is pivoted via the ball joint 85 in a direction to move the end thereof away from the frame 54. As a result, the movable arm 16*a* is pressed in the closing direction by the presser 76.

Therefore, ever where there is a fluctuation in size of bobbins B, any of the bobbins B will be held firmly on the bobbin holder 60 at the opposite ends of the cradle arm 16.

Figure 32:
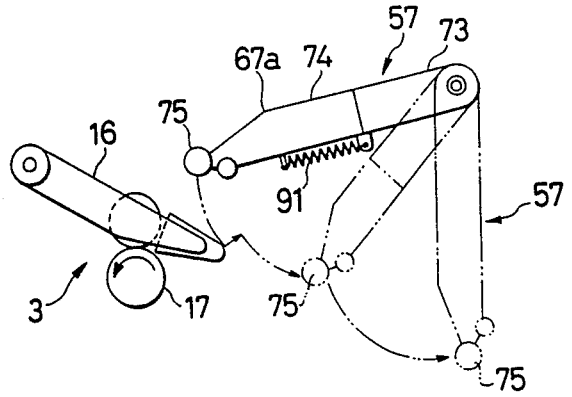

After then, the cradle operating arm 57 is moved back to its position parallel to the frame 54 and is then pivoted downwardly as shown in FIG. 32. Consequently, the cradle arm 16 is pivoted downwardly so that the bobbin B is contacted with and rotated by the friction roller 17. Substantially at the same time, yarn is threaded onto the bobbin B whereafter the yarn is wound up onto the bobbin B.

Since the contacting pressure between the bobbin B and the friction roller 17 is relatively low upon starting of winding of the bobbin B, the bobbin B is pressed into contacting engagement with the friction roller 17 via the cradle arm 16 by the operating roller 75 of the cradle operating arm 57 in order to maintain good rotation of the bobbin B.

When yarn is wound up onto the bobbin B and the cradle operating arm 57 is pivoted downwardly, the slide arm 74 mounted for sliding movement on the movable base portion 73 of the cradle operating arm 57 is moved so as to contract itself as shown in FIG. 32 against a force of the spring 91. As the cradle operating arm 57 is pivoted downwardly further, the operating roller 75 thereon is moved away from the end of the movable arm 16*a*. The cradle operating arm 57 is stopped after its has been pivoted to a vertical position shown in two dot chain lines in FIG. 32.

In this condition, bunch windings and then main windings within a predetermined traverse range are wound on a surface of the bobbin B. Thus, winding of yarn is performed with the wound yarn and the friction roller 17 held in a good contacting condition. After then, when yarn is wound fully onto the bobbin, the operation described hereinabove will be carried out again.

As apparent from the foregoing description, according to the present invention, following good effects can be exhibited.

(1) Since a bobbin chucking device is provided for horizontal turning motion and also for up and down pivotal motion, a bobbin on a peg stand can be received and mounted onto a yarn winding device by the same bobbin chucking device.

(2) Since no delivery of a bobbin occurs in a doffing truck as distinct from the preceding patent application (Japanese Patent Application No. 60-227476), a time required for such delivery can be saved and the structure does not require a large size and is economical accordingly.

What is claimed is:

1. A false twisting machine including a doffing truck which travels between a plurality of juxtaposed yarn winding units and a peg stand located in an opposing relationship to said yarn winding units and exchanges empty bobbins mounted on pegs of said peg stand for fully wound packages from said yarn winding units, characterized in that said doffing truck comprises a plurality of support arms, each support arm being mounted for horizontal turning motion for receiving a fully wound package from one of said yarn winding units and mounting the received fully wound package onto one of said pegs of said peg stand, a plurality of bobbin chucking devices, each bobbin chucking device being mounted for receiving bobbin from the peg stand and directly supplying the bobbin onto one of said yarn winding units, and driving means for supporting and moving said plurality of support arms and said plurality of bobbin chucking devices on the doffing truck.

2. The false twisting machine as claimed in claim 1, wherein each bobbin chucking device comprises means for gripping an empty bobbin on a peg stand and moving it onto one of the winding units and releasing it in the winding unit.

3. The false twisting machine as claimed in claim 2, wherein said driving means includes a slide frame for reciprocal movement between the yarn winding units and the peg stand.

4. The false twisting machine as claimed in claim 3, wherein each support arm is mounted for up and down movement relative to the slide frame for reciprocal movement between the yarn winding units and the peg stand and also for horizontal turning motion for receiving a fully wound package from one of the yarn winding units and for mounting it onto one of the pegs of the peg stand.

5. The false twisting machine as claimed in claim 4, wherein each bobbin chucking device is mounted for up and down movement and also for horizontal turning motion and up and down pivotal motion of the slide frame for holding a bobbin thereon and mounting the bobbin onto a yarn winding unit.

6. The false twisting machine as claimed in claim 5, wherein said slide frame is held in threaded engagement with a threaded rod and is moved reciprocally by the threaded rod to be guided along a guide rail located at upper location of the doffing truck.

7. The false twisting machine as claimed in claim 6, wherein said driving means further includes a vertical guide frame fixed at a lower portion of the slide frame, a liftable base being movable along the guide frame, a vertical guide rod which is rotatably mounted on the liftable base, and a connecting shaft which is also mounted on the liftable base to be parallel to and to be rotatable independently to the vertical guide rod.

8. The false twisting machine as claimed in claim 7, wherein each support arm is securely mounted on said vertical guide rod.

9. The false twisting machine as claimed in claim 7, wherein each bobbin chucking device is freely supported by said vertical guide rod and is connected to the connecting shaft.

10. The false twisting machine as claimed in claim 9, wherein each bobbin chucking device comprises a turning base portion fitted around the guide rod and turned in a horizontal direction, an up and down pivotal arm supported for up and down pivotal motion on the turning base portion, a shaft supported at an end of the pivotal arm, and a pair of bobbin chuckers which are provided on both sides of the shaft.

11. The false twisting machine as claimed in claim 10, wherein each bobbin chucker comprises a base plate, a pair of gripping pawls, connected at opposite ends of the base plate, springs urging the gripping pawls in a closing direction and rollers provided to be rotatably at an end of each of the gripping pawls.

12. The false twisting machine as claimed in claim 11, wherein each bobbin chucker is rockable around the shaft to be a center and an arcuate guide member is secured on an outer side portion of one of the base plate of the bobbin chucker so that a bobbin is precisely positioned on a bobbin holder of a cradle arm of the winding unit.

13. The false twisting machine as claimed in claim 8, wherein each support arm includes a frame portion fitted for horizontal turning motion around the guide rod, a pair of arm portions provided in an integral relationship on the frame portion and each having at an end thereof a receiving portion for receiving an end of a bobbin thereon and a holding pawl provided on one side edge of the arm portions for pivotal motion for holding a bobbin of a package supported on the receiving portions.

14. The false twisting machine as claimed in claim 10, wherein a bobbin positioning device which includes a positioning plate mounted on the turning base portion of each bobbin chucking device, and a positioning cylinder mounted on a frame of the doffing truck for pressing an end portion of a bobbin against the positioning plate is further located on the doffing truck for adjusting the gripped position of a bobbin when the bobbin is mounted onto each winding units by the bobbin chucking device.

15. A false twisting machine as claimed in claim 1, wherein the winding units each further comprises:

a plurality of cradle arms, each having a movable arm and, wherein the doffing truck further comprises, a plurality of cradle operating arms, each for pivoting one of the movable arms in a substantially vertical direction and for moving the movable arm in a substantially horizontal direction, and actuating means for pivoting the cradle operating arms, located on a frame of the doffing truck.

16. A false twisting machine as claimed in claim 15, wherein each cradle operating arm further comprises:

an operating arm portion moved in the substantially vertical directions and moved in the substantially horizontal directions for operating the movable arm of the cradle arm, and a mounting portion for supporting the operating arm portion of the frame.

17. A false twisting machine as claimed in claim 16, wherein the operating arm portion further comprises:

a turning support arm supported on the mounting portion, a rockable arm connected to an end of the turning support arm, a pin to connect the rockable arm to the end of the turning support arm, a movable base portion mounted on the rockable arm and extending in a direction toward the movable arm, a slide arm mounted for sliding movement on the movable base portion, an operating roller mounted at an end of the slide arm for engaging with the movable arm, and a presser for pressing against the movable arm.

18. A false twisting machine as claimed in claim 17, wherein the actuating means further comprises:

a first cylinder connected to the operating arm portions for moving the operating arm portions the horizontal directions, and a second cylinder for pivoting the operating arm portion in the vertical directions.

19. A doffing truck for exchanging a plurality of packages fully wound on a corresponding plurality of yarn winding units for a corresponding plurality of empty bobbins mounted on a peg stand, said doffing truck comprising:

a plurality of support arms, each of said support arms having a first exchanging means for receiving a substantially fully wound package from one of the winding units and mounting the received package on the peg stand;

a plurality of bobbin chucking devices, each of said bobbin chucking devices having second exchanging means for receiving a bobbin from the peg stand and for supplying the bobbin to one of the winding units; and driving means for moving said plurality of support arms and said plurality of bobbin chucking devices.

20. A doffing truck as claimed in claim 19, wherein said driving means comprises a slide frame operable for reciprocally moving said support arms and said bobbin chucking devices toward and away from the yarn winding units and the peg stand.

* * * * *